US008654160B2

(12) United States Patent
Kano

(10) Patent No.: US 8,654,160 B2
(45) Date of Patent: Feb. 18, 2014

(54) PRINTING CONTROL APPARATUS

(71) Applicant: Brother Kogyo Kabushiki Kaisha, Nagoya (JP)

(72) Inventor: Yasutoshi Kano, Kariya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/849,573

(22) Filed: Mar. 25, 2013

(65) Prior Publication Data

US 2013/0208071 A1 Aug. 15, 2013

Related U.S. Application Data

(63) Continuation-in-part of application No. PCT/JP2012/056994, filed on Mar. 19, 2012.

(30) Foreign Application Priority Data

Mar. 31, 2011 (JP) ..... 2011-079681

(51) Int. Cl.
*B41J 2/36* (2006.01)

(52) U.S. Cl.
USPC ..... 347/188; 347/194; 347/211; 347/186

(58) Field of Classification Search
USPC ..... 347/171, 188, 194, 211, 189, 190, 195, 347/196, 185, 186; 400/120.01, 120.09, 400/120.14, 120.15, 120.1
See application file for complete search history.

(56) References Cited

U.S. PATENT DOCUMENTS

| | | | | | |
|---|---|---|---|---|---|
| 4,806,970 | A * | 2/1989 | Nakatomi et al. | ..... | 399/122 |
| 4,827,286 | A * | 5/1989 | Sukigara et al. | ..... | 347/185 |
| 5,025,267 | A * | 6/1991 | Schofield et al. | ..... | 347/194 |
| 5,451,988 | A * | 9/1995 | Ono | ..... | 347/185 |
| 5,706,043 | A * | 1/1998 | Okada et al. | ..... | 347/185 |
| 7,271,819 | B2 * | 9/2007 | Matsutani et al. | ..... | 347/196 |
| 8,384,750 | B2 * | 2/2013 | Matsutani | ..... | 347/211 |
| 2005/0219350 | A1 | 10/2005 | Matsutani et al. | | |
| 2013/0033555 | A1 * | 2/2013 | Matsutani | ..... | 347/211 |

FOREIGN PATENT DOCUMENTS

| | | | | |
|---|---|---|---|---|
| EP | 1582363 | 10/2005 | | |
| JP | 60-92378 | * 5/1985 | ..... | 347/186 |
| JP | 60-255463 | * 12/1985 | ..... | 347/186 |
| JP | 63-045067 | 2/1988 | | |

(Continued)

OTHER PUBLICATIONS

Japanese International Search Report for PCT/JP2012/056994.

(Continued)

*Primary Examiner* — Huan Tran
(74) *Attorney, Agent, or Firm* — McCarter & English, LLP

(57) ABSTRACT

In a printing control apparatus, there are arranged one pulse application period of which from-start-to-end is series of sub-pulse application time, main-pulse application time and non-heating time and other pulse application periods which follow the one pulse application period and of which from-start-to-end is repeated series of main-pulse application times and non-heating times. As temperature is higher, proportion of applied-for-sub-pulse energy amount to total energy amount in one pulse application period is made larger. As temperature is higher, proportion of applied-for-main-pulse energy amount to total energy amount in other pulse application periods that follow one pulse application period is made smaller.

6 Claims, 10 Drawing Sheets

(56) References Cited

FOREIGN PATENT DOCUMENTS

| | | |
|---|---|---|
| JP | 63-178062 | 7/1988 |
| JP | 63-280662 | 11/1988 |
| JP | 4-310760 | 11/1992 |
| JP | 5-219330 | 8/1993 |
| JP | 7-089115 | 4/1995 |
| JP | 9-314882 | 12/1997 |
| JP | 2912645 | 6/1999 |
| JP | 2000-185425 | 7/2000 |
| JP | 2005-280099 | 10/2005 |
| JP | 4442282 | 3/2010 |

OTHER PUBLICATIONS

International Preliminary Report on Patentability issued in PCT/JP2012/056994 on Oct. 17, 2013.

* cited by examiner

| PRNTG SPEED (mm/s) | SUB (μJ/dot) | MAIN (μJ/dot) | PROPN OF SUB (TO TOTAL) | PROPN OF MAIN (TO TOTAL) |
|---|---|---|---|---|
| 30 | 100 | 540 | 16% | 84% |
| 20 | 110 | 800 | 12% | 88% |
| 15 | 120 | 980 | 11% | 89% |
| 10 | 130 | 1200 | 10% | 90% |

FIG. 9

| TMP DETECTED W/ THERMISTOR (°C) | SUB (μJ/dot) | MAIN (μJ/dot) | PROPN OF SUB (TO TOTAL) | PROPN OF MAIN (TO TOTAL) |
|---|---|---|---|---|
| 5 | 110 | 810 | 12% | 88% |
| 15 | 125 | 780 | 14% | 86% |
| 25 | 155 | 705 | 18% | 82% |
| 35 | 185 | 590 | 24% | 76% |
| 45 | 210 | 465 | 31% | 69% |
| 55 | 225 | 340 | 40% | 60% |
| 65 | 230 | 240 | 49% | 51% |

PRINTING CONTROL APPARATUS

CROSS REFERENCE TO RELATED APPLICATIONS

The present application is a continuation-in-part of PCT International Patent Application No. PCT/JP2012/056994 filed on Mar. 19, 2012, which claims priority from Japanese Patent Application No. JP 2011-079681, filed on Mar. 31, 2011, the disclosure of which is incorporated herein by reference in its entirety.

TECHNICAL FIELD

The disclosure relates to a printing control apparatus that controls a thermal head subjected to application of a main pulse or a sub pulse.

BACKGROUND

There has conventionally been known a thermal printer as example of a printing apparatus that controls a thermal head subjected to application of a main pulse or a sub pulse.

In a conventional thermal printer, there has been the conventional problem as follows: generally, a thermal printer carries out printing by selectively heating a plurality of heater elements arranged at least in one row on its thermal head. Heating of selected heater elements is carried out by applying a driving pulse to each selected heater element for predetermined period of time. In addition to application of a main pulse for heating the selected heater element, a sub pulse shorter in pulse application period of time than a main pulse is applied at the beginning of printing so as to compensate energy shortage and to prevent a weak print-out. Thus, in the case of thermal printing, the thermal head accumulates heat as printing continues further. In a case where patterns are continuously printed with high density at high heating temperature, heat accumulation can possibly cause printing faults such as characters printed bolder than intended, unclear print-out, etc.

The above description will be explained in detail hereinafter. As shown in FIG. 10, there is assumed a case to successively print out plural dots P1, P2, P3 . . . from the beginning of printing. In the above conventional printing control, there is arranged one (first) pulse application period F1 made up of a series of a sub-pulse application time S, a main-pulse application time M1 and a non-heating time C1 for printing out a dot P1. Subsequent to the one (first) pulse application period F1, there is arranged other (second) pulse application period F2 made up of a series of a main-pulse application time M2 and a non-heating time C2 for printing out a dot P2. Subsequent to the other (second) pulse application period F2, there is further arranged other (third) pulse application period F3 made up of a series of a main-pulse application time M3 and a non-heating time C3 for printing out a dot P3. In similar with the above, subsequent to the other (third) pulse application period F3, there are further arranged other (fourth and after) pulse application periods each of which is made up of a series of a main-pulse application time and a non-heating time for printing out a dot subsequent to a previous dot. Incidentally, in the drawings of the present application, a pulse application is indicated as low active and electric power supplied during pulse application is constant.

In the one (first) pulse application period F1, for energy shortage compensation, there is secured the sub-pulse application time S. That is, a sub pulse with short energization time is applied so that the dot P1 is printed out without a weak print-out.

In the pulse application periods F1, F2, F3 . . . , there are respectively secured main-pulse application times M1, M2, M3 . . . . For printing out each of the dots P1, P2, P3 . . . , a main pulse with long energization time is applied in each main-pulse application time.

In this connection, it is preferable to correct length of the sub-pulse application time S and that of each of the main-pulse application times M1, M2, M3, . . . , depending on temperature of heater elements on the thermal head. However, it is difficult to directly measure temperature of heater elements on the thermal head. Therefore, length of an application time is corrected based on temperature detected by a thermistor disposed at a location set off from heater elements on the thermal head. Accordingly, length of each of non-heating times C1, C2, C3 . . . is corrected, as well.

Temperature detected with the thermistor is lower than actual temperature of heater elements on the thermal head. As printing continues further, difference between measured temperature and actual temperature of heater elements grows. The thermal head accumulates heat.

In addition, as printing speed is made faster, the thermal head is more likely to accumulate heat. This is because temperature at heater elements on the thermal head does not go down sufficiently to reach predetermined temperature. Regarding other (second and after) pulse application periods F to follow the one (first) pulse application period F1, FIG. 11 comparatively shows configuration of a pulse application period F at printing speed of 10 mm/sec. and that of a pulse application period F at printing speed of 30 mm/sec. As shown in FIG. 11, proportion of a main-pulse application time M to a pulse application period F of the latter one is larger than that of the former one. In other words, proportion of a non-heating time C to an application period F of the latter one is smaller than that of the former one. Accordingly, as shown in FIG. 12, temperature at heater elements on the thermal head goes down to reach 50 degrees Celsius or lower when printed at printing speed of 10 mm/sec., whereas temperature thereof cannot go down to reach 50 degrees Celsius or lower when printed at printing speed of 30 mm/sec. or faster.

The above such heat accumulation in the thermal head becomes more significant as temperature detected with the thermistor is higher.

As explained in detail, as continuous printing goes further, as printing speed is made faster, or as temperature detected with a thermistor is higher, a thermal heard is more likely to accumulate heat. Heat accumulation could possibly cause printing faults such as characters printed bolder than intended, unclear print-out, etc.

Even if length of application time is corrected from the one (first) application period F1 simply in consideration of continuous printing, printing speed and heat accumulation of a thermal head, the correction of pulse application time from the one (first) application period F1 can adversely cause pulse-application energy shortage in a case where sufficient heat accumulation has not been secured before the start of the one (first) application period F1. That is, even if a sub-pulse application time S is secured in the one (first) application period F1, pulse-application energy shortage can possibly occur and make weak print-out of the dot P inevitable in the case where sufficient heat accumulation has not been secured before the start of the one (first) application period F1.

SUMMARY

The disclosure has been made in view of the above mentioned problem and the object thereof is to provide a printing control apparatus capable of avoiding weak print-out of a dot in one pulse application period as well as avoiding unclear print-out in other pulse application periods that follow the one pulse application period.

To achieve the object, there is provided a printing control apparatus comprising: a thermal head; heater elements arranged on the thermal head; a temperature measuring unit that measures temperature at a location away from the heater elements; and a pulse application unit that controls a pattern of energization time to heat the heater elements in repeated pulse application periods based on temperature measured with temperature measuring unit, the pulse application unit controlling the pattern of energization time by using controlling factors: a factor (1) that one type of the repeated pulse application periods is one pulse application period of which from-start-to-end is a series of a sub-pulse application time, a main-pulse application time and a non-heating time; a factor (2) that other type of the repeated pulse application periods is other pulse application period which follows the one pulse application period and of which from-start-to-end is a series of a main-pulse application time and a non-heating time; a factor (3) that, as temperature measured with the temperature measuring unit is higher, proportion of applied-for-sub-pulse energy amount to total energy amount in the one pulse application period is made larger, the total energy amount being a sum of applied-for-sub-pulse energy amount and applied-for-main-pulse energy amount in the one pulse application period; and a factor (4) that, as temperature measured with the temperature measuring unit is higher, proportion of the applied-for-main-pulse energy amount to the total energy amount in the one pulse application period is made smaller.

Further, according to the disclosure for solving the problem, there is provided a printing control apparatus comprising: a thermal head; heater elements arranged, on the thermal head; a printing-speed calculating unit that calculates printing speed with the heater elements; and a pulse application unit that controls a pattern of energization time to heat the heater elements in repeated pulse application periods based on printing speed calculated with the printing-speed calculating unit, the pulse application unit controlling the pattern of energization time by using controlling factors: a factor (1) that one type of the repeated pulse application periods is one pulse application period of which from-start-to-end is a series of a sub-pulse application time, a main-pulse application time and a non-heating time; a factor (2) that other type of the repeated pulse application periods is other pulse application period which follows the one pulse application period and of which from-start-to-end is a series of a main-pulse application time and a non-heating time; a factor (3) that, as printing speed calculated with the printing-speed calculating unit is faster, proportion of applied-for-sub-pulse energy amount to total energy amount in the one pulse application period is made larger, the total energy amount being a sum of applied-for-sub-pulse energy amount and applied-for-main-pulse energy amount in the one pulse application period; and a factor (4) that, as printing speed calculated with the printing-speed calculating unit is faster, proportion of the applied-for-main-pulse energy amount to the total energy amount in the one pulse application period is made smaller.

BRIEF DESCRIPTION OF THE DRAWINGS

FIG. 9 is a table showing relation between temperature detected at the thermistor and to-be-applied energy amount in the printing control of the disclosure;

DETAILED DESCRIPTION

A detailed description of an exemplary embodiment of a printing control apparatus embodying the disclosure will now be given referring to the accompanying drawings.

[1. External Configuration of the Disclosure]

Figure 3:
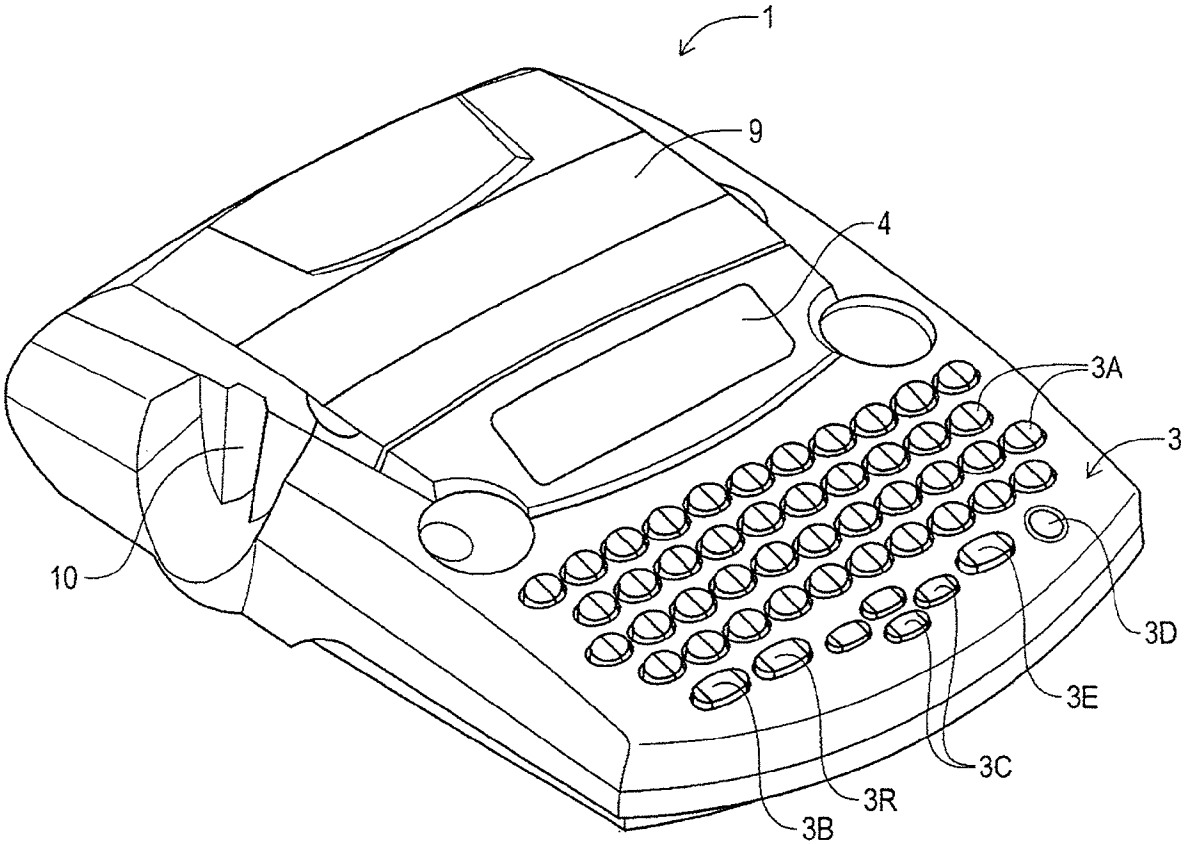
FIG. 3 is an external perspective view of a tape printing apparatus subject to printing control of the disclosure.

Next, schematic configuration of the present embodiment will be described by referring drawings. As shown in FIG. 3, the tape printing apparatus 1 of which thermal head is subject to printing control is a printer for carrying out printing on a tape fed from a tape cassette 5 (refer to FIG. 4) housed inside a cabinet of the tape printing apparatus 1. The tape printing apparatus 1 includes a keyboard 3 and a liquid crystal display 4 on the top of the cabinet. Further, there is arranged a cassette holding portion 8 (refer to FIG. 4) for holding the tape cassette 5. The cassette holding portion 8 is a rectangular shape when seen from top, placed inside the cabinet from a top portion thereof and covered by a housing cover 9. Beneath the keyboard 3, a control board (not shown) constituting a control circuit portion is arranged. A tape ejecting portion 10 for ejecting a printed tape is formed at the left side of the cassette holding portion 8. Further, a connection interface (not shown) is arranged at the right side of the tape printing apparatus 1. The connection interface is used for connecting the tape printing apparatus 1 to an external apparatus (e.g., a personal computer, etc.) in a manner of either wire line connection or wireless connection. Accordingly, the tape printing apparatus 1 is capable of printing out printing data transmitted from an external apparatus.

The keyboard 3 includes plural operation keys such as letter input keys 3A, a print key 3B, cursor keys 3C, a power key 3D, a setting key 3E, a return key 3R, etc. The letter input keys 3A are operated for inputting letters that create texts consisting of document data. The print key 3B is operated for commanding to print out printing data consisting of created texts, etc. The cursor keys 3C are operated for moving a cursor being indicated in the liquid crystal display 4 up, down, left or right. The power key 3D is operated for turning on or off the power of the main body of the tape printing apparatus 1. The setting key 3E is operated for setting various conditions. The return key 3R is operated for executing a line feeding instruction or various processing and for determining a choice from candidates.

The liquid crystal display 4 is a display device for indicating characters such as letters, etc. in plural lines, i.e., displaying printing data created by the keyboard 3.

Figure 4:
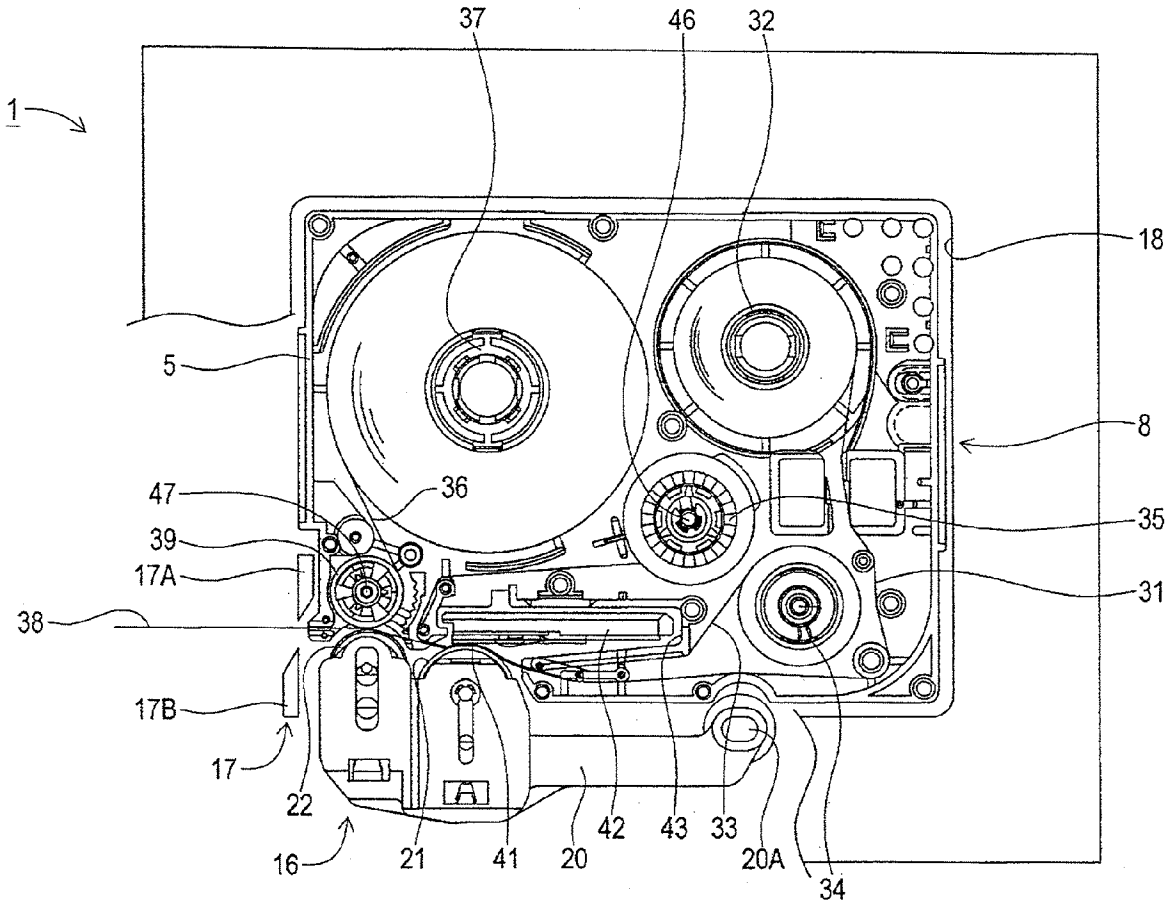
FIG. 4 is a plane view showing a cassette holding portion and periphery thereof in the tape printing apparatus.
Figure 5:
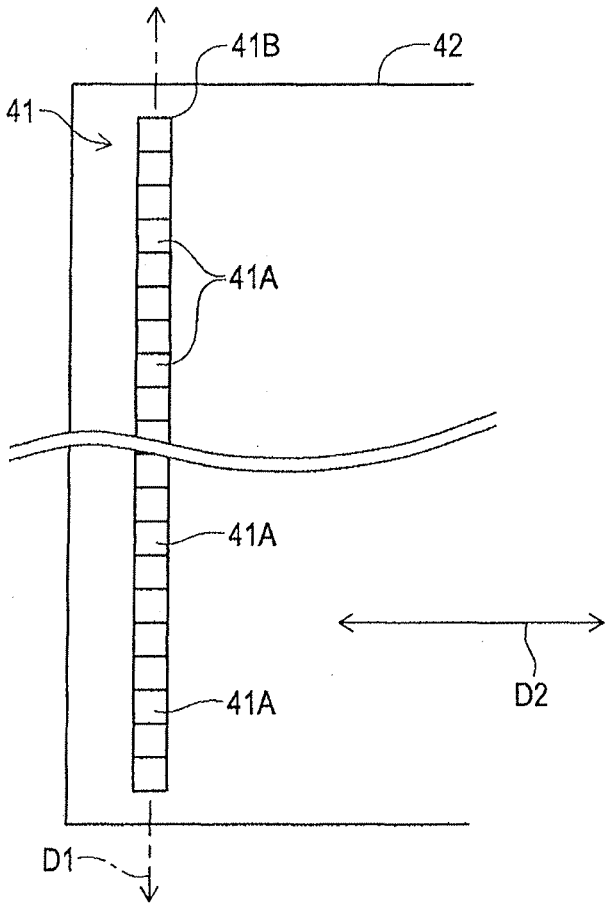
FIG. 5 is an enlarged view of a thermal head of the tape printing apparatus.

As shown in FIG. 4, the tape printing apparatus 1 is configured such that the tape cassette 5 can be replaceably placed in the cassette holding portion 8 arranged inside thereof. Further, inside the tape printing apparatus 1, there are arranged a tape driving and printing mechanism 16 and tape cutting mechanism including a cutter 17. The tape printing apparatus 1 is capable of carrying out printing onto a tape fed from the tape cassette 5 by the tape driving and printing mechanism 16 in accordance with desired printing data. Further, the tape printing apparatus 1 is capable of cutting off a printed part of a tape with the cutter 17 constituting the tape cutting mechanism. The printed part of the tape thus cut off is ejected from the tape ejecting portion 10 formed on the left side of the tape printing apparatus 1.

Inside the tape printing apparatus 1, a cassette holding frame 18 is arranged. As shown in FIG. 4, the tape cassette 5 is replaceably placed into the cassette holding frame 18.

The tape cassette 5 includes a tape spool 32, a ribbon feeding spool 34, a used-ribbon-take-up spool 35, a base-material-sheet feeding spool 37 and a bonding roller 39 in a rotatably-supported manner, inside thereof. A surface tape 31 is wound around the tape spool 32. The surface tape 31 is made of a transparent tape such as PET (polyethylene terephthalate) film or the like. An ink ribbon 33 is wound around the ribbon feeding spool 34. On the ink ribbon 33, there is applied ink that melts or sublimes when heated so as to form an ink layer. A part of the ink ribbon 33 that has been used for printing is taken up in the used-ribbon-take-up spool 35. A double tape 36 is wound around the base-material-sheet feeding spool 37. The double tape 36 is configured so as to bond the surface tape 31 and a release tape to one side and the other side of a double-sided adhesive tape wherein the double-sided adhesive tape includes adhesive agent layers at both sides thereof with width the same as width of the surface tape 31. The double tape 36 is wound around the base-material-sheet feeding spool 37 so that the release tape is located outside. The bonding roller 39 is used for bonding the double tape 36 and the surface tape 31 together.

As shown in FIG. 4, in the cassette holding frame 18, an arm 20 is arranged around a shaft 20A in a pivotal manner. A platen roller 21 and a conveying roller 22 are rotatably supported at the front edge of the arm 20. Both the platen roller 21 and the conveying roller 22 employ a flexible member made of rubber or the like for their surfaces. When the arm 20 fully swings clockwise, the platen roller 21 presses the surface tape 31 and the ink ribbon 33 against a thermal head 41 to be described later. At the same time, the conveying roller 22 presses the surface tape 31 and the double tape 36 against the bonding roller 39.

A plate 42 is arranged upright inside the cassette holding frame 18. The plate 42 includes the thermal head 41 at its side surface facing the platen roller 21. The thermal head 41 consists of a line head 41B or the like made up of a plurality (e.g. 128) of heater elements 41A aligned in the width direction of the surface tape 31 and the double tape 36. In this connection, a direction that the heater elements 41A are aligned is defined as "main scanning direction D1 for the thermal head 41". Further, a direction that the surface tape 31 and the ink ribbon 33 moves passing the thermal head 41 is defined as "sub scanning direction for the thermal head 41". The "sub scanning direction D2 for the thermal head 41" is orthogonal to the "main scanning direction D1 for the thermal head 41". Reverting to FIG. 4, when the tape cassette 5 is placed in a predetermined position, the plate 42 is fitted in a concave portion 43 of the tape cassette 5.

Further, as shown in FIG. 4, a ribbon-take-up roller 46 and a bonding-roller driving roller 47 are arranged upright inside the cassette holding frame 18. When the tape cassette 5 is placed in the predetermined position, the ribbon-take-up roller 46 and the bonding-roller driving roller 47 are inserted in the used-ribbon-take-up spool 35 and the bonding roller 39 of the tape cassette 5, respectively.

Figure 6:
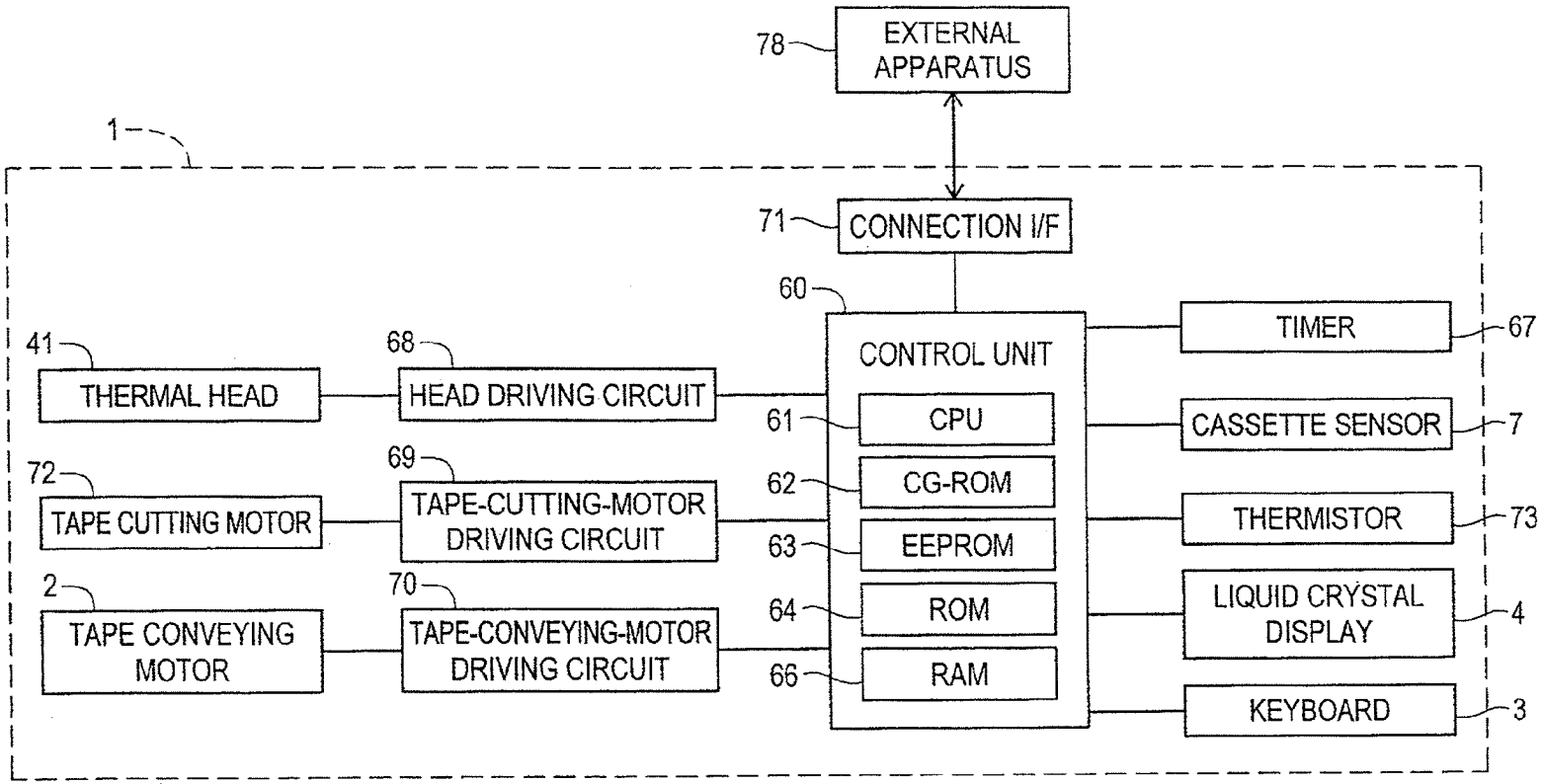
FIG. 6 is a block diagram for illustrating control system of the tape printing apparatus.

In the cassette holding frame 18, there is arranged a tape conveying motor 2 (refer to FIG. 6). Driving force of the tape conveying motor 2 is transmitted to the platen roller 21, the conveying roller 22, the ribbon-take-up roller 46 and the bonding-roller driving roller 47, etc. via series of gears arranged along the cassette holding frame 18. Accordingly, when rotation of an output shaft of the tape conveying motor 2 is started with supply of power to the tape conveying motor 2, rotation of the used-ribbon-take-up spool 35, the bonding roller 39, the platen roller 21 and the conveying roller 22 is started in conjunction with the operation of the tape conveying motor 2. Thereby, the surface tape 31, the ink ribbon 33 and the double tape 36 in the tape cassette 5 are loosed out from the tape spool 32, the ribbon feeding spool 34 and the base-material-sheet feeding spool 37, respectively, and are conveyed in a downstream direction (toward the tape ejecting portion 10 and the used-ribbon-take-up spool 35).

Thereafter, the surface tape 31 and the ink ribbon 33 are bonded together and go through a path between the platen roller 21 and the thermal head 41 in a superimposed state. Accordingly, in the tape printing apparatus 1 of the present embodiment, the surface tape 31 and the ink ribbon 33 are conveyed with being pressed by the platen roller 21 and the thermal head 41. The significant number of the heater elements 41A aligned on the thermal head 41 are selectively and intermittently energized (in a manner of pulse application) by a control unit 60 (refer to FIG. 6) in accordance with printing data and a printing control program. Incidentally the energization control of the thermal head 41 will be described in detail later.

Each heater element 41A gets heated by power supply and melts or sublimes ink applied on the ink ribbon 33. Therefore, ink in the ink layer on the ink ribbon 33 is transferred onto the surface tape 31 in a certain unit of dots. Consequently, a printing-data-based dot image desired by a user is formed on the surface tape 31 as mirror image.

After passing through the thermal head 41, the ink ribbon 33 is taken up by the ribbon-take-up roller 46. On the other hand, the surface tape 31 is superimposed onto the double tape 36 and goes through a path between the conveying roller 22 and the bonding roller 39 in a superimposed state. At the same time, the surface tape 31 and the double tape 36 are pressed against each other by the conveying roller 22 and the boding roller 39 so as to form a laminated tape 38. Of the laminated tape 38, a printed-side surface of the surface tape 31 furnished with dot printing and the double tape 36 are firmly superimposed together. Accordingly, a user can see a normal image of the printed image from the reversed side for the printed-side surface of the surface tape 31 (i.e., the top side of the laminated tape 38).

Thereafter, the laminated tape 38 is conveyed further downstream with respect to the conveying roller 22 to reach the tape cutting mechanism including the cutter 17. The tape cutting mechanism consists of the cutter 17 and the tape cutting motor 72 (refer to FIG. 6). The cutter 17 includes a fixed blade 17A and a rotary blade 17B. More specifically, the cutter 17 is a scissors-like cutter that cuts off an object to be cut off by rotating the rotary blade 17B against the fixed blade 17A. The rotary blade 17B is arranged so as to be able to rotate back and forth with reference to a shaft thereof with the aid of the tape cutting motor 72. Accordingly, the laminated tape 38 is cut off with the fixed blade 17*a* and the rotary blade 17B along operation of the tape cutting motor 72. The laminated tape 38 thus cut off is ejected outside of the tape printing apparatus 1 via the tape ejecting portion 10. By peeling off the release paper from the double tape 36 and exposing the adhesive agent layer, the laminated tape 38 can be used as adhesive label that can be adhered to an arbitrary place.

[2. Control Configuration of Tape Printing Apparatus]

Next, the control configuration of the tape printing apparatus 1 will be described in detail by referring to drawings. As shown in FIG. 6, inside the tape printing apparatus 1, there is arranged a control board (not shown) on which a control unit 60, a timer 67, a head driving circuit 68, a tape-cutting-motor driving circuit 69 and a tape-conveying-motor driving circuit 70 are arranged.

The control unit 60 consists of a CPU 61, a CG-ROM 62, an EEPROM 63, a ROM 64 and a RAM 66. Furthermore, the control unit 60 is connected to the timer 67, the head driving circuit 68, the tape-cutting-motor driving circuit 69 and the tape-conveying-motor driving circuit 70. The control unit 60 is also connected to the liquid crystal display 4, a cassette sensor 7, a thermistor 73, the keyboard 3 and a connection interface 71. The CPU 61 is a central processing unit that plays a primary role for various system control of the tape printing apparatus 1. Accordingly, the CPU 61 controls various peripheral devices such as the liquid crystal display 4 etc. in accordance with input signals from the keyboard 3 as well as various control programs to be described later.

The CG-ROM 62 is a character generator memory wherein image data of to-be-printed letters and signs are associated with code data and stored in dot patterns. The EEPROM 63 is a non-volatile memory that allows data write for storing therein and deletion of stored data therefrom. The EEPROM 63 stores data that indicates user setting etc. of the tape printing apparatus 1. The ROM 64 stores various control programs and various data for the tape printing apparatus 1. Accordingly, control programs and data tables are stored in the ROM 64.

The RAM 66 is a storing device for temporarily storing a processing result of the CPU 61 etc. The RAM 66 also stores printing data created with inputs by means of the keyboard 3, printing data taken therein from external apparatus 78 via the connection interface 71. The timer 67 is a time-measuring device that measures passage of predetermined length of time for executing control of the tape printing apparatus 1. More specifically, the timer 67 is referred for detecting start and termination of an energization (pulse application) period for a heater element 41A on the thermal head 41. Further, the thermistor 73 is a sensor that detects temperature in the vicinity of the thermal head 41 and attached on a location away from the thermal head 41 by predetermined distance.

The head driving circuit 68 is a circuit that serves to supply a driving signal to the thermal head 41 for controlling drive state of the thermal head 41 along control programs executed by the CPU 61. In this connection, the head driving circuit 68 controls to energize and de-energize (pulse application) each of the heater elements 41A based on a signal (strobe (STB) signal) associated with a strobe number assigned to each heater element 41A for comprehensively controlling heating manner of the thermal head 41. The tape-cutting-motor driving circuit 69 is a circuit that serves to supply a driving signal to the tape cutting motor 72 in response to a control signal from the CPU 61 for controlling operation of the tape cutting motor 72. Further, the tape-conveying motor driving circuit 70 is a control circuit that serves to supply a driving signal to a tape conveying motor 2 based on the control programs for controlling operation of the tape conveying motor 2.

[3. Printing Control of Tape Printing Apparatus]

Next, there will be described on printing control of the disclosure executed with the tape printing apparatus 1 in detail by referring to drawings. In the printing control of the disclosure executed with the tape printing apparatus 1, the CPU 61 executes the control program stored in the ROM 64 so as to output a control signal to the head driving circuit 68 from the CPU 61. In response to the control signal thus outputted, a driving signal is supplied from the head driving circuit 68 to the thermal head 41. In accordance with the driving signal supplied thereto, driving of each heater element 41A on the thermal head 41 is controlled.

Figure 10:
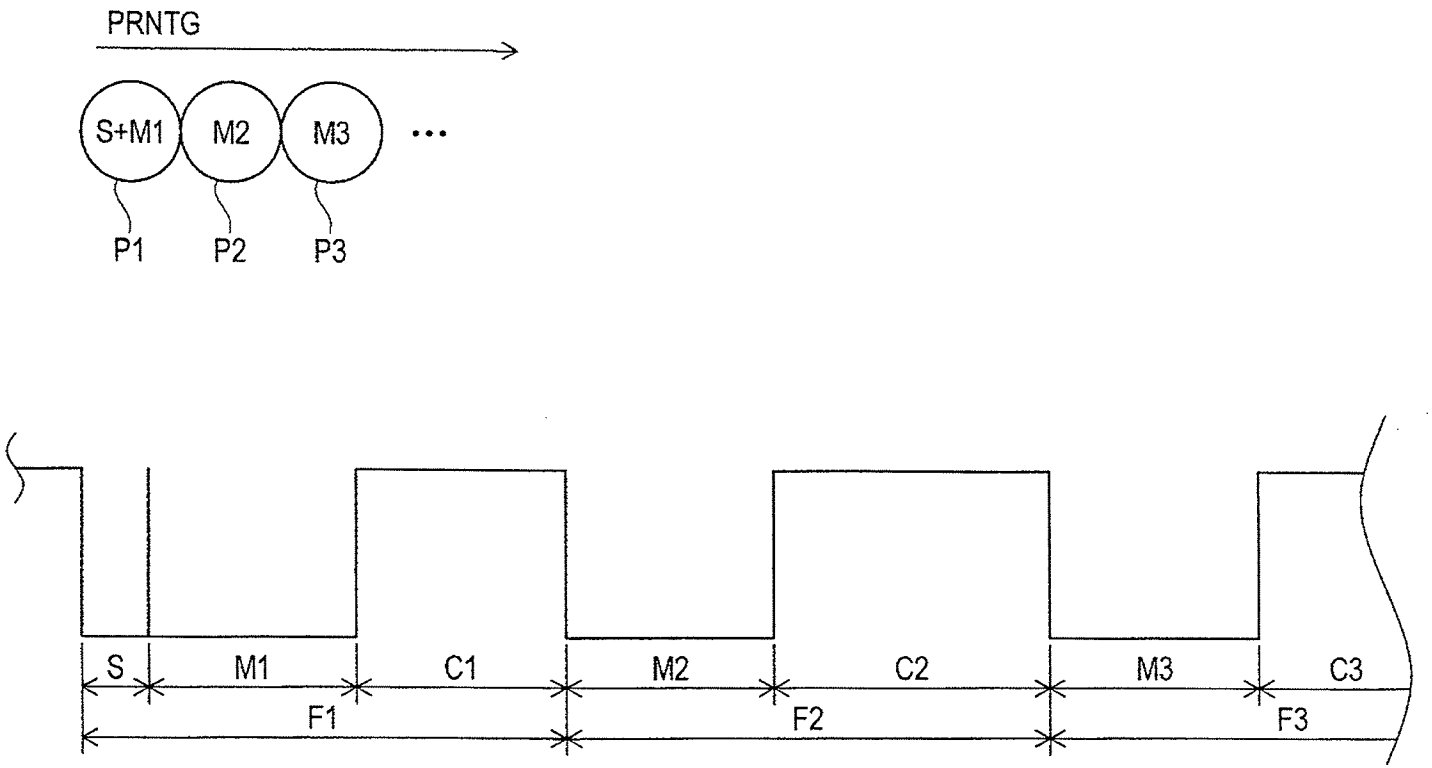
FIG. 10 is a view for schematically illustrating pulse application periods in conventional printing control.
Figure 11:
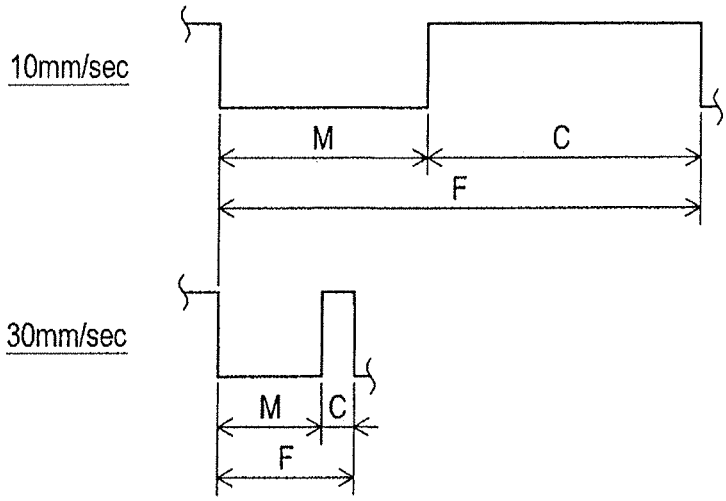
FIG. 11 is a view of conventional printing control at other (second or after) pulse application period that follows one (first) application period for comparatively showing between printing control at printing speed of 10 mm/sec. and printing control at printing speed of 30 mm/sec.
Figure 12:
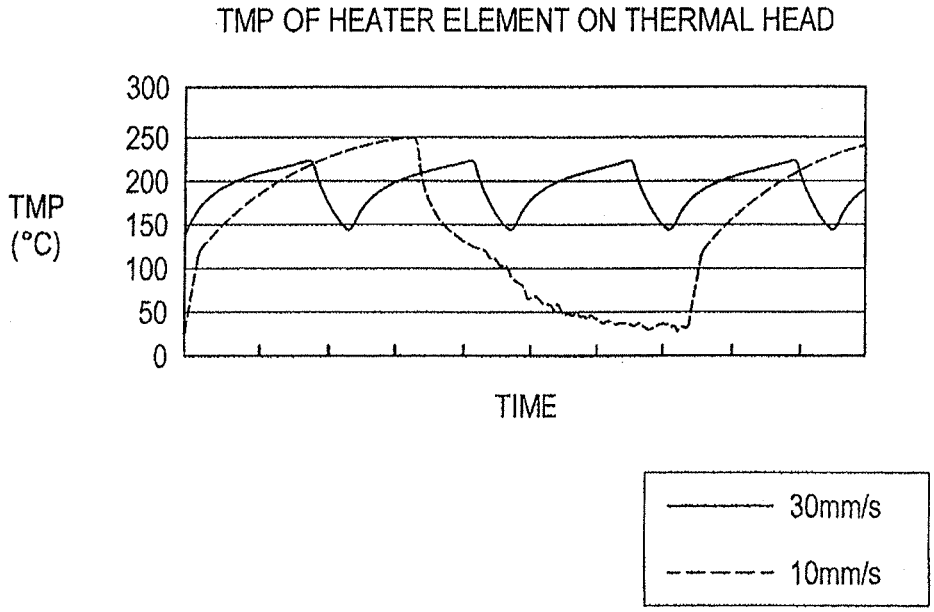
FIG. 12 is a view of the conventional printing control with respect to temperature of heater element on a thermal head for comparatively showing between printing control at printing speed of 10 mm/sec. and printing control at printing speed of 30 mm/sec.

As shown in FIG. 10, here will be assumed a case to successively print out plural dots P1, P2, P3 . . . from the beginning of printing. In similar with conventional printing control, there is arranged one (first) pulse application period F1 made up of a series of a sub-pulse application time S, a main-pulse application time M1 and a non-heating time C1 for printing out a dot P1. Subsequent to the one (first) pulse application period F1, there is further arranged other (second) pulse application period F2 made up of a series of a main-pulse application time M2 and a non-heating time C2 for printing out a dot P2. Subsequent to the other (second) pulse application period F2, there is further arranged other (third) pulse application period F3 made up of a series of a main-pulse application time M3 and a non-heating time C3 for printing out a dot P3. In Similar to the above, subsequent to the (third) pulse application period F3, there are further arranged other (fourth and after) pulse application periods each of which is made of a series of a main-pulse application time and a non-heating time for printing out a dot subsequent to a previous dot. As previously mentioned, in the drawings of the present application, a pulse application is indicated as low active and electric power supplied during pulse application is constant.

In the one (first) pulse application period F1, for energy shortage compensation, there is secured a sub-pulse application time S. That is, a sub pulse is applied so that the dot P1 is printed out without a week print-out.

In pulse application periods F1, F2, F3, . . . , there are respectively secured main-pulse application times M1, M2, M3 . . . so that main pulses are applied there for printing out respective dots P1, P2, P3 . . . .

Figure 2:
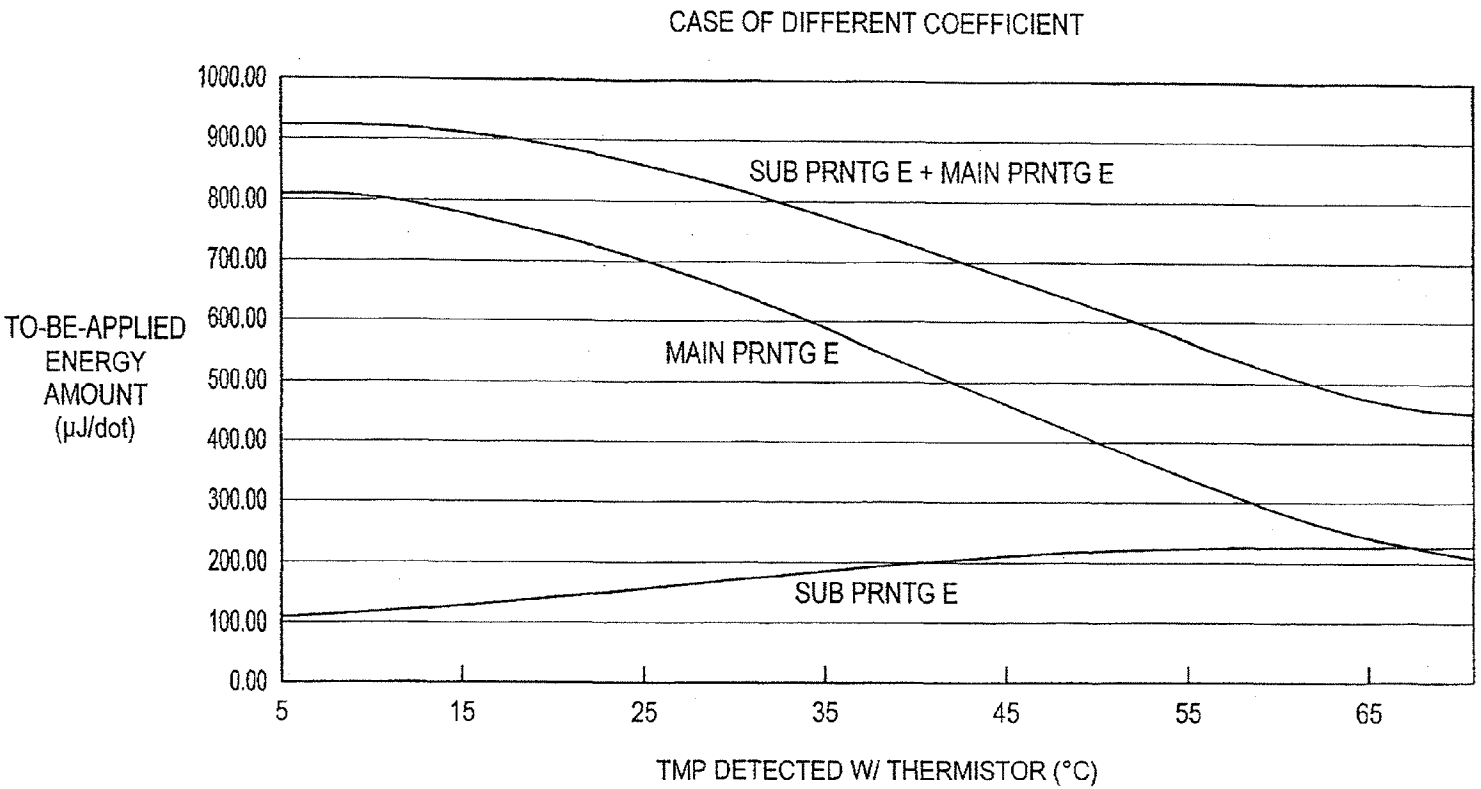
FIG. 2 is a diagram showing relation between temperature detected at a thermistor and to-be-applied energy amount in the printing control of the disclosure.

Different from conventional printing control, regarding the sub-pulse application time S and each of the main-pulse application times M1, M2, M3 . . . , to-be-applied energy amount in each of the above sub/main-pulse application times is corrected depending on temperature detected with the thermistor 73, wherein the correction of the to-be-applied energy amount is made based on data table shown in FIG. 9. FIG. 2 specifically shows characteristic feature of the data table directed to FIG. 9 in a form of a graph. With the consequence of correction on the to-be-applied energy amount, non-heating times C1, C2, C3 . . . are properly corrected, as well.

More specifically, FIG. 2 reflects characteristic feature of the data table of FIG. 9 in a form of a graph. In FIG. 2, "SUB PRNTG E" stands for applied-for-sub-pulse energy amount, "MAIN PRNTG E" for applied-for-main-pulse energy amount and "SUB PRNTG E+MAIN PRNTG E" for total energy amount which is a sum of applied-for-sub-pulse energy amount and applied-for-main-pulse energy amount. Incidentally, the ROM 64 stores the data table of FIG. 9 corresponding to characteristic features indicated in FIG. 2 in a form of graph.

The characteristic features indicated in FIG. 2 in a form of graph are summed up into the following (A1) through (A3).

(A1) Proportion of applied-for-sub-pulse energy amount ("SUB PRNTG E") to total energy amount is made larger as temperature detected with the thermistor 73 is higher whereas proportion of applied-for-main-pulse energy amount ("MAIN PRNTG E") is made smaller as temperature detected with the thermistor 73 is higher.

(A2) Total energy amount ("SUB PRNTG E+MAIN PRNTG E"), i.e., a sum of applied-for-sub-pulse energy amount ("SUB PRNTG E") and applied-for-main-pulse energy amount ("MAIN PRNTG E"), is made smaller as temperature detected with the thermistor 73 is higher.

(A3) In percentage terms, increasing rate of applied-for-sub-pulse energy amount (gradient of "SUB PRNTG E") to be made larger in accordance with rise of temperature detected with the thermistor 73 is smaller than reduction rate of applied-for-main-pulse energy amount (gradient of "MAIN PRNTG E") to be made smaller in accordance with rise of temperature detected with the thermistor 73.

Figure 1:
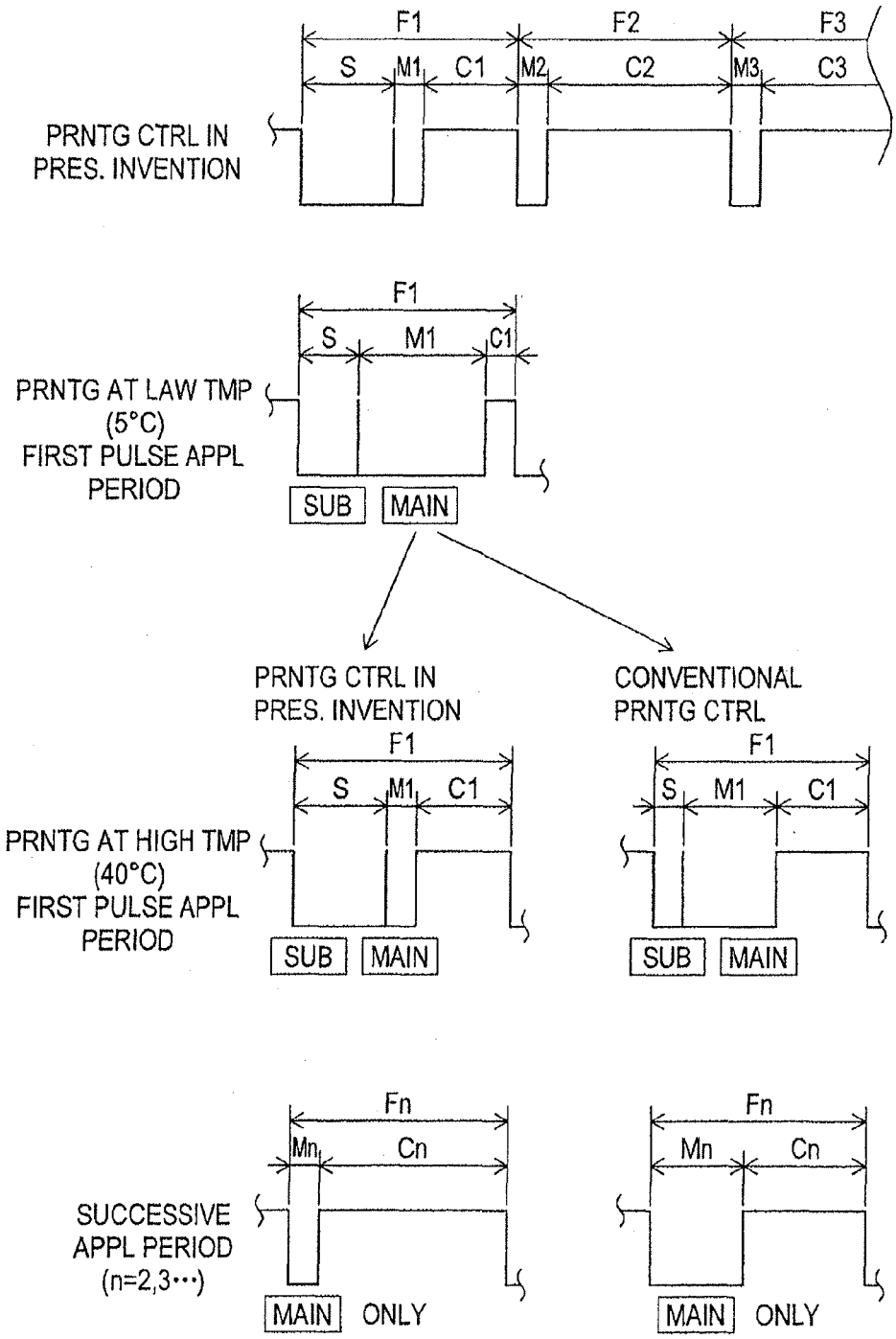
FIG. 1 is a diagram for schematically illustrating printing control of the present disclosure.

As shown in FIG. 1, FIG. 2 and FIG. 9, in a case where temperature detected with the thermistor 73 is 5 degrees Celsius, i.e., at low temperature for printing, a sub-pulse application time S and a main-pulse application time M1 both included in one (first) pulse application period F1 for printing out a dot P1 are corrected so that applied-for-sub-pulse energy amount approximates 100 μJ/dot and applied-for-main-pulse energy amount approximates 800 μJ/dot.

Incidentally, printing control at the above case, i.e., the case of printing at low temperature, is similar with conventional printing control.

On the other hand, in a case where temperature detected with the thermistor 73 is 40 degrees Celsius, i.e., at high temperature for printing, a sub-pulse application time S and a main-pulse application time M1 both included in one (first) pulse application period F1 for printing out a dot P1 are corrected so that applied-for-sub-pulse energy amount approximates 200 μJ/dot and applied-for-main-pulse energy amount approximates 500 μJ/dot.

In this case, i.e., the case of printing at high temperature, the sub-pulse application time S in the one (first) pulse application period F1 is made long and a main-pulse application time M1 in the one (first) pulse application period F1 is made short, in comparison with the same case of the conventional printing control. In other words, in the printing control directed to the disclosure, in the case where temperature detected with the thermistor 73 is 40 degrees Celsius, i.e., at high temperature for printing, applied-for-sub-pulse energy amount in the one (first) pulse application period F1 is made larger and applied-for-main-pulse energy amount in the one (first) pulse application period F1 is made smaller in comparison with the conventional printing control at the same high-temperature printing condition.

Further, when dots P2, P3 . . . are successively printed out in other (second and after) pulse application periods F2, F3 . . . that successively follow the one (first) pulse application period F1, temperature detected with the thermistor 73 is usually 40 to 70 degrees Celsius, i.e., high for printing. In the case of the above high temperature, applied-for-main-pulse energy amount is determined between approximately 500 μJ/dot and 200 μJ/dot depending on temperature detected with the thermistor 73. Thereby, the main-pulse application times M2, M3 . . . respectively included in other (second and after) pulse application periods F2, F3 . . . that successively follow the one (first) pulse application period F1 are independently corrected so that the thus determined energy amount should be applied for each of the main pulses.

Even in this case, i.e., the case of printing at high temperature, each of the main-pulse application times M2, M3 . . . respectively included in other (second and after) pulse application periods F2, F3 . . . that successively follow the one (first) pulse application period F1 is made shorter in comparison with the same case of the conventional printing control. In other words, in the printing control directed to the disclosure, in the case where dots are successively printed and temperature detected with the thermistor 73 is 40 to 70 degrees Celsius, i.e., the case at high temperature for continuous printing, energy amount for each of main pulses in the other (second and after) pulse application periods F2, F3 . . . that successively follow the one (first) pulse application period F1 is made smaller in comparison with conventional printing control at the same conditions.

[4. Summary]

As shown in FIG. 1, the tape printing apparatus 1 of the present embodiment is configured to include one (first) pulse application period F1 of which from-start-to-end is a series of a sub-pulse application time S, a main-pulse application time M1 and a non-heating time C1 and other (second and after) pulse application periods F2, F3 . . . which successively follow the one (first) pulse application period and of which from-star-to-end are series of main-pulse application times M2, M3 . . . and non-heating times C2, C3 . . . .

As shown in FIG. 2, in the one (first) pulse application period F1, proportion of applied-for-sub-pulse energy amount ("SUB PRNTG E") to total energy amount is made larger as temperature detected with the thermistor 73 is higher. Further, in other (second and after) pulse application periods F2, F3 . . . which successively follow the one (first) pulse application period, proportion of applied-for-main-pulse energy amount ("MAIN PRNTG E") is made smaller as temperature detected with the thermistor 73 is higher.

Thereby, there is secured to-be-applied energy amount necessary to print out the dot P1 in the one (first) pulse application period F1. Further, by positively using accumulated heat for each of the other (second and after) pulse application periods F2, F3 . . . that successively follow the one (first) pulse application period F1, to-be-applied energy amount necessary to print out dots P2, P3 . . . is secured at lower level in comparison with conventional printing control and heat accumulation is suppressed. Accordingly, there can be avoided weak print-out of the dot P1 in the one (first) pulse application period F1 and unclear print-out of the dots P2, P3 . . . at other pulse (second and after) application periods F2, F3 . . . that successively follow the one (first) pulse application period F1.

Further, according to the tape printing apparatus 1 of the present embodiment, in each of the other (second and after) pulse application periods F2, F3 . . . that successively follow the one (first) pulse application period F1, as temperature detected with the thermistor 73 is higher, proportion of applied-for-main-pulse energy amount ("MAIN PRNTG E") to total energy amount is made smaller. In other words, proportion of each non-heating times C2, C3 . . . to each of the other (second and after) pulse application periods F2, F3 . . . is made longer as temperature detected with the thermistor 73 is higher. Therefore, power consumption can be suppressed.

Further, according to the tape printing apparatus 1 of the present embodiment, as shown in FIG. 2, total energy amount ("SUB PRNTG E+MAIN PRNTG E") which is a sum of applied-for-sub-pulse energy amount ("SUB PRNTG E") and applied-for-main-pulse energy amount ("MAIN PRNTG E") at the one (first) pulse application period F1 is made smaller as temperature detected with the thermistor 73 is higher. This is to attend to the matter of heat accumulation of which influence becomes more significant as temperature detected with the thermistor 73 is higher. Thereby, the printing control in this manner simultaneously satisfies prevention of weak print-out of a dot P1 in one (first) pulse application period F1 and suppression of power consumption.

Further, according to the tape printing apparatus 1 of the present embodiment, as shown in FIG. 2, in percentage terms, increasing rate of applied-for-sub-pulse energy amount ("SUB PRNTG E") to be made larger in accordance with rise of temperature detected with the thermistor 73 is smaller than reduction rate of applied-for-main-pulse energy amount ("MAIN PRNTG E") to be made smaller in accordance with rise of temperature detected with the thermistor 73. Thereby, there is secured to-be-applied energy amount necessary to print out the dot P1 in the one (first) pulse application period F1. At the same time, as temperature detected with the thermistor 73 is higher, to-be-applied energy amount necessary to print out dots P2, P3 . . . at respective other pulse (second and after) application periods F2, F3 . . . that successively follow the one (first) pulse application period F1 is secured at lower level in comparison with conventional printing control.

In addition to the typical case where plural pulse application periods F1, F2, F3 . . . for respectively printing out dots P1, P2, P3 . . . are arranged so as to successively print out dots P1, P2, P3, . . . from the start of printing, there may be a case where pulse application periods F1, F2, F3 . . . are arranged so as to successively print out dots P1, P2, P3, . . . immediately after non-printed dot.

[5. Others]

While presently exemplary embodiments has been shown and described, it is to be understood that this disclosure is for the purpose of illustration and that various changes and modifications may be made without departing from the scope of the disclosure.

Figures 7, 8:
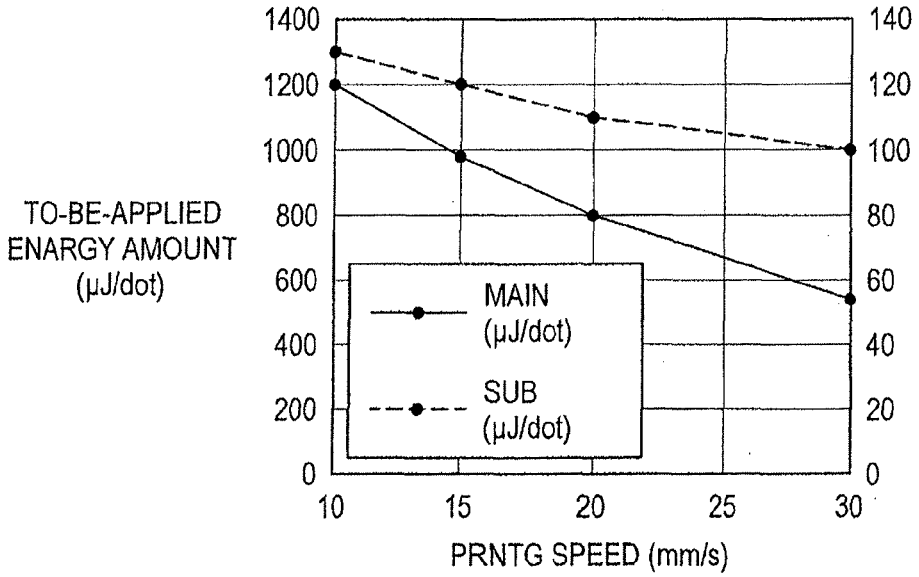
FIG. 7 is a table showing relation between printing speed and to-be-applied energy amount in the printing control of the disclosure.
FIG. 8 is a graph showing relation between printing speed and to-be-applied energy amount in the printing control of the disclosure.

Regarding the sub-pulse application time S and each of the main-pulse application times M1, M2, M3 . . . , different-mannered printing control is applicable in place of printing control in accordance with data table of FIG. 9 of which characteristic feature is reflected in FIG. 2 in a form of graph, namely, in place of printing control with to-be-applied energy amount determined depending on temperature detected with the thermistor 73. For instance, there may be applied variant printing control in accordance with data table of FIG. 7 of which characteristic feature is reflected in FIG. 8 in a form of graph, namely, printing control with to-be-applied energy amount determined in accordance with printing speed previously calculated by the CPU 61. Even with this variant printing control, there can be obtained working effect similar with the printing control of the embodiment. Incidentally, the data table shown in FIG. 7 is stored in the ROM 64, as well.

In a case of printing control at printing speed of 10 mm/sec., length of a sub-pulse application time S and that of a main-pulse application time M1 both included in one (first) pulse application period F1 for printing out a dot P1 are corrected so that applied-for-sub-pulse energy amount (SUB) approximates 130 μJ/dot and applied-for-main-pulse energy amount (MAIN) approximates 1200 μJ/dot. In this case, proportion of the applied-for-sub-pulse energy amount (SUB) to total energy amount that is a sum of applied-for-sub-pulse energy amount (SUB) and applied-for-main-pulse energy amount (MAIN) is 10% and proportion of the applied-for-main-pulse energy amount (MAIN) to the total energy amount is 90%. Further, regarding other (second and after) pulse application periods F2, F3 . . . for printing out dots P2, P3 . . . that follow the one (first) pulse application period F1, length of main-pulse application times M2, M3 . . . respectively included in the other (second and after) pulse application periods F2, F3 . . . are individually corrected so that applied-for-main-pulse energy amount pulse (MAIN) approximates 1200 μJ/dot.

In a case of printing control at printing speed of 15 mm/sec., length of a sub-pulse application time S and that of a main-pulse application time M1 both included in one (first) pulse application period F1 for printing out a dot P1 are corrected so that applied-for-sub-pulse energy amount (SUB) approximates 120 μJ/dot and applied-for-main-pulse energy amount (MAIN) approximates 980 μJ/dot. In this case, proportion of the applied-for-sub-pulse energy amount (SUB) to total energy amount that is a sum of applied-for-sub-pulse energy amount (SUB) and applied-for-main-pulse energy amount (MAIN) is 11% and proportion of the applied-for-main-pulse energy amount (MAIN) to the total energy amount is 89%. Further, regarding other (second and after) pulse application periods F2, F3 . . . for respectively printing out dots P2, P3 . . . that follow the one (first) pulse-application period F1, length of main-pulse application times M2, M3 . . . respectively included in the other (second and after) pulse application periods F2, F3 . . . are individually corrected so that applied-for-main-pulse energy amount (MAIN) approximates 980 μJ/dot.

In a case of printing control at printing speed of 20 mm/sec., length of a sub-pulse application time S and that of a main-pulse application time M1 both included in one (first) pulse application period F1 for printing out a dot P1 are corrected so that applied-for-sub-pulse energy amount (SUB) approximates 110 μJ/dot and applied-for-main-pulse energy amount (MAIN) approximates 800 μJ/dot. In this case, proportion of the applied-for-sub-pulse energy amount (SUB) to total energy amount that is a sum of applied-for-sub-pulse energy amount (SUB) and applied-for-main-pulse energy amount (MAIN) is 12% and proportion of the applied-for-main-pulse energy amount (MAIN) to the total energy amount is 88%. Further, regarding other (second and after) pulse application periods F2, F3 . . . for respectively printing out dots P2, P3 . . . that follow the one (first) pulse-application period F1, length of main-pulse application times M2, M3 . . . respectively included in the other (second and after) pulse application periods F2, F3 . . . are individually corrected so that applied-for-main-pulse energy amount (MAIN) approximates 800 μJ/dot.

In a case of printing control at printing speed of 30 mm/sec., length of a sub-pulse application time S and that of a main-pulse application time M1 both included in one (first) pulse application period F1 for printing out a dot P1 are corrected so that applied-for-sub-pulse energy amount (SUB) approximates 100 μJ/dot and applied-for-main-pulse energy amount (MAIN) approximates 540 μJ/dot. In this case, proportion of the applied-for-sub-pulse energy amount (SUB) to total energy amount that is a sum of applied-for-sub-pulse energy amount (SUB) and applied-for-main-pulse energy amount (MAIN) is 16% and proportion of the applied-for-main-pulse energy amount (MAIN) to the total energy amount is 84%. Further, regarding other (second and after) pulse application periods F2, F3 . . . for respectively printing out dots P2, P3 . . . that follow the one (first) pulse-application period F1, length of main-pulse application times M2, M3 . . . respectively included in the other (second and after) pulse application periods F2, F3 . . . are individually corrected so that applied-for-main-pulse energy amount (MAIN) approximates 540 μJ/dot.

The characteristic features indicated in FIG. 8 in a form of graph are summed up into the following (B1) through (B3).

(B1) Applied-for-sub-pulse energy amount (SUB) is made larger as printing speed gets faster whereas applied-for-main-pulse energy amount (MAIN) is made smaller as printing speed gets faster.

(B2) Total energy amount, i.e., a sum of applied-for-sub-pulse energy amount (SUB) and applied-for-main-pulse energy amount (MAIN), is made smaller as printing speed gets faster.

(B3) In percentage terms, increasing rate of applied-for-sub-pulse energy amount (SUB) to be made larger in accordance with rise of printing speed is smaller than reduction rate of applied-for-main-pulse energy amount (MAIN) to be made smaller in accordance with rise of printing speed.

As described in the above, electric power supplied during pulse application shown in the drawings of the present embodiments is constant. Since to-be-applied energy amount is a product of electric power and length of energization time, applied-for-main-pulse energy amount, applied-for-sub-pulse energy amount and proportion between those energy amounts can be changed by changing length of energization time.

What is claimed is:

1. A printing control apparatus comprising:

a thermal head;

heater elements arranged on the thermal head;

a temperature measuring unit that measures temperature at a location away from the heater elements; and a pulse application unit that controls a pattern of energization time to heat the heater elements in repeated pulse application periods based on temperature measured with temperature measuring unit, the pulse application unit controlling the pattern of energization time by using controlling factors:

a factor (1) that one type of the repeated pulse application periods is one pulse application period of which from-start-to-end is a series of a sub-pulse application time, a main-pulse application time and a non-heating time;

a factor (2) that other type of the repeated pulse application periods is other pulse application period which follows the one pulse application period and of which from-start-to-end is a series of a main-pulse application time and a non-heating time;

a factor (3) that, as temperature measured with the temperature measuring unit is higher, proportion of applied-for-sub-pulse energy amount to total energy amount in the one pulse application period is made larger, the total energy amount being a sum of applied-for-sub-pulse energy amount and applied-for-main-pulse energy amount in the one pulse application period; and a factor (4) that, as temperature measured with the temperature measuring unit is higher, proportion of the applied-for-main-pulse energy amount to the total energy amount in the one pulse application period is made smaller.

2. The printing control apparatus according to claim 1, wherein, as temperature is higher, the total application energy amount in the one pulse application period is made smaller.

3. The printing control apparatus according to claim 1, wherein, in percentage terms, increasing rate of the sub-pulse application energy amount to be made larger in accordance with rise of temperature is smaller than reduction rate of the main-pulse application energy to be made smaller in accordance with the rise of temperature.

4. A printing control apparatus comprising:

a thermal head;

heater elements arranged on the thermal head;

a printing-speed calculating unit that calculates printing speed with the heater elements; and a pulse application unit that controls a pattern of energization time to heat the heater elements in repeated pulse application periods based on printing speed calculated with the printing-speed calculating unit, the pulse application unit controlling the pattern of energization time by using controlling factors:

a factor (1) that one type of the repeated pulse application periods is one pulse application period of which from-start-to-end is a series of a sub-pulse application time, a main-pulse application time and a non-heating time;

a factor (2) that other type of the repeated pulse application periods is other pulse application period which follows the one pulse application period and of which from-start-to-end is a series of a main-pulse application time and a non-heating time;

a factor (3) that, as printing speed calculated with the printing-speed calculating unit is faster, proportion of applied-for-sub-pulse energy amount to total energy amount in the one pulse application period is made larger, the total energy amount being a sum of applied-for-sub-pulse energy amount and applied-for-main-pulse energy amount in the one pulse application period; and a factor (4) that, as printing speed calculated with the printing-speed calculating unit is faster, proportion of the applied-for-main-pulse energy amount to the total energy amount in the one pulse application period is made smaller.

5. The printing control apparatus according to claim 4, wherein, as printing-speed is faster, the total application energy amount in the one pulse application period is made smaller.

6. The printing control apparatus according to claim 4, wherein, in percentage terms, increasing rate of the sub-pulse application energy amount to be made larger in accordance with rise of printing speed is smaller than reduction rate of the main-pulse application energy to be made smaller in accordance with the rise of printing speed.

* * * * *